US005682942A

United States Patent [19]

Perrin et al.

[11] Patent Number: 5,682,942

[45] Date of Patent: Nov. 4, 1997

[54] METHOD OF LUBRICATING THE WALLS OF A MOLD FOR THE CONTINUOUS CASTING OF METALS AND MOLD FOR ITS IMPLEMENTATION

[75] Inventors: Eric Perrin, Metz; Jacques Spiquel, Montigny-lès-Metz; Jean-Marc Jolivet, Guenange, all of France; Pierre Courbe, Spa; Paul Naveau, Alleur, both of Belgium

[73] Assignees: Unimetal Societe Francaise Des Aciers Longs, Rombas; Ascometal, Puteaux, both of France; Centre De Recherches Metallurgiques-Centrum Voor Research in De Metallurgie, Solvay, Belgium; Sollac, Puteaux; Ugine Savoie, Ugine, both of France; Societe Anonyme Des Forges et Acieries de Dilling, Dillingen, Germany

[21] Appl. No.: 638,749

[22] Filed: Apr. 29, 1996

[30] Foreign Application Priority Data

May 17, 1995 [FR] France ..... 95 05 794

[51] Int. Cl.[6] ..... B22D 11/16; B22D 11/07; B22D 11/04

[52] U.S. Cl. ..... 164/452; 164/154.4; 164/472; 164/268; 164/416; 164/478

[58] Field of Search ..... 164/472, 268, 164/418, 459, 416, 478, 452, 154.4

[56] References Cited

U.S. PATENT DOCUMENTS

| | | | |
|---|---|---|---|
| 4,917,171 | 4/1990 | Economopoulos et al. | 164/472 |
| 5,271,452 | 12/1993 | Lorento | 164/459 |

FOREIGN PATENT DOCUMENTS

| | | | |
|---|---|---|---|
| 1314127 | 3/1993 | Canada . | |
| 0499563 | 8/1985 | European Pat. Off. . | |
| 0160635 | 11/1985 | European Pat. Off. . | |
| 620062 | 10/1994 | European Pat. Off. . | |
| 2704786 | 11/1994 | France . | |
| 2708222 | 3/1995 | France . | |
| 57-103758 | 6/1983 | Japan . | |
| 3-47660 | 2/1991 | Japan | 164/472 |

*Primary Examiner*—Joseph J. Hail, III
*Assistant Examiner*—L-H. Lin
*Attorney, Agent, or Firm*—Sizbey Friedman Leedom & Ferguson; Thomas W. Cole

[57] ABSTRACT

The subject of the invention is a method of lubricating a mold (1) for the continuous casting of a metal product (16), of the type including a vigorously-cooled vertically-oscillating metal tubular element (2) defining a passage (4) for the cast metal and intended to cause, in contact with its wall (3) in said passage, the solidification of said metal product, in which a lubricant in the liquid state is injected through said metal tubular element toward said metal product being solidified, wherein said injection is carried out at points distributed annularly at a single level of said tubular element, said level lying at a distance greater than 20 cm from the lowest level at which solidification of said product is able to be initiated, and in that the flow rate of said lubricant is sufficient to cause a fraction of said lubricant to rise up along said wall to the level at which solidification of said product is effectively initiated.

6 Claims, 3 Drawing Sheets

METHOD OF LUBRICATING THE WALLS OF A MOLD FOR THE CONTINUOUS CASTING OF METALS AND MOLD FOR ITS IMPLEMENTATION

FIELD OF THE INVENTION

The invention relates to the field of the continuous casting of metals. More precisely, it relates to the method of lubricating the molds of conventional continuous-casting plants and also to the molds of so-called "continuous casting with liquid-metal head" plants in which it is desired to distance the surface of the liquid metal within the mold from the zone where solidification of the cast product starts.

The operation for the conventional continuous casting of steel consists diagrammatically in continuously pouring the molten metal into a bottomless vertical tubular oscillating mold, having metal walls (de of copper or copper alloy) which are vigorously cooled by the internal circulation of water, and in extracting therefrom, also continuously, a product (slab, bloom or billet, depending on the dimensions of the mold) which has already solidified on the outside to a thickness of several centimeters. The solidification of this product is completed in the lower stages of the machine, where the product is firstly, on leaving the mold, forcibly cooled by spraying water and then cooled naturally. Next, it is cut to the desired length. The purpose of the oscillation of the mold is to prevent the solidified skin of the product from sticking locally to the wall of the mold, which would tear the skin, causing "breakout", that is to say the flow of liquid metal through this tear. Such incident would consequently require immediate stoppage of the casting, with the risk of causing serious damage to the machine.

It is important for the good quality of rolled products which will sty therefrom that these continuous-cast products have surface and subcutaneous defects which are as small as possible. However, the oscillation and flow of the livid within the mold cause incessant variations in the level of the surface of the liquid metal in the mold, in line with which surface the skin of the product starts to solidify on the cooled wall. These variations are the main cause for the periodic appearance of irregularities on the surface of the product, such as solidified hooks and oscillation marks, the magnitude of which it is desired to minimize.

PRIOR ART

A known remedy to this problem consists in distancing the surface of the liquid metal within the mold from the level at which solidification of the product is initiated. For this purpose, a non-cooled tubular element, called "bush", is placed on the upper rim of the cooled metallic element of the mold lying along the extension thereof, and the flow rate of metal introduced and the rate of casting are adjusted so as to keep the surface of the metal inside the bush. Since the latter is made of a heat-insulating material, such as an aluminous refractory, solidification of the skin of the product is not, in principle, initiated on its walls, and starts only at the level of the metallic element. The fluctuations in the level of the liquid metal surface thus no longer affect the zone where solidification is initiated. The latter takes place very uniformly and leads to a surface and subcutaneous quality of the products which are markedly improved compared to conventional continuous casting plants. Such plants are usually designated by the term "continuous casting with liquid-metal head" plants.

Furthermore, in these plants, the submerged nozzle which conveys the liquid metal into the mold has its open end held inside the bush. The metal contained in the bush therefore constitutes a buffer volume which dampens the turbulence due to the influx of metal before it reaches the level of the metallic element. This also contributes to providing greater uniformity in the solidification of the first layers of metal compared to the case of conventional continuous casting, in which this turbulence affects the entire upper part of the cooled metallic element and may slow down the solidification in the vicinity of the highly recirculating zones.

In order to guarantee that solidification starts right at the level of the metallic element, it is possible, as recommended in document EP 0,620,062, to inject a pressurized inert gas at the junction between the refractory element and the metallic element. In this way, it is intended to shear the solid skin which has been able, undesirably, to start to form already on the walls of the bush in the case where, for example, the latter has not yet attained its complete thermal equilibrium.

It is absolutely essential, in conventional continuous casting or in continuous casting with liquid-metal head, to lubricate the internal wall of the cooled metallic element of the mold so as to ensure good slippage of the solidified skin of the product being extracted and thus to prevent breakouts. In conventional continuous casting, two methods may be used. One consists in depositing on the surface of the liquid metal a cover powder based on oxides and on fluxes. It forms a liquid layer at its interface with the metal and, at the periphery of the mold, this liquid, on which the composition of the powder confers lubricating properties, infiltrates between the wall and the solidified skin. Moreover, this powder picks up the non-metallic inclusions which have risen to the surface of the metal, protects the liquid metal against atmospheric reoxidation and stops radiation emitted by the metal. The requirements on the composition of the powder, which especially governs its fluidity at the powder/metal interface, are not the same for all these functions. The choice of the composition is therefore necessarily a compromise which does not enable any of them to be optimized. The other method of lubrication consists in depositing on the surface of the metal within the mold a layer of oil, such as colza oil, so that it infiltrates between the wall and the solidified skin. Very high quality lubrication is thus achieved, but the functions of trapping inclusions, protecting the metal against reoxidation and stopping radiation are no longer provided. This method is therefore only occasionally used in plants for the casting of very small-format products cast in free-stream mode (with no submerged nozzle). In such plants, if a cover powder were to be used, the impact of the casting stream on the surface of the metal would cause entrainment of the powder into the mold and therefore serious contamination of the metal.

Among these two methods, the first cannot be transposed to the case of casting with liquid-metal head. The powder which has to be deposited on the surface of the metal in the bush, in order to protect the metal and to pick up the inclusions, cannot come up to the upper level of the metallic element, where solidification of the skin is initiated, and therefore plays no role in the lubrication. Moreover, it is inconceivable to inject powder at the junction between the bush and the metallic element since this would cause contamination of the metal by that fraction of the powder which, inevitably, would be entrained into it. It is therefore chosen to lubricate the mold by injecting oil around the internal periphery of the metallic element, in the vicinity of its junction with the bush. This is achieved, for example, by inserting between them a cooled metal insert provided with a slot. However, achieving satisfactory lubrication over the entire height of the metallic element (this usually has a length of about 700 mm) is problematical. The reason for this is that the very high temperature at the point of injection leads to partial cracking of the oil, and the evolution of gases (essentially CO and methane) which results therefrom must remain at a limited level in order not to cause the metal to boil in the mold. Therefore oil may be injected only with a relatively modest flow rate since increasing this flow rate to a value which will be sufficient to lubricate the mold correctly from top to bottom would lead to an unacceptably high level of gas evolution. It is therefore necessary to supplement this oil injection at the bush/metallic element junction with an additional injection made in the lower part of the metallic element. This thus ensures that the final tens of centimeters of the mold will be correctly lubricated, but this complicates the construction of the mold somewhat more.

The object of the invention is to propose a method enabling the entire cooled metallic part of the mold of any continuous casting plant to be optimally lubricated, so that it would in all cases make it possible to use a liquid lubricant in conventional continuous casting and so that it would simplify the design of molds for continuous casting with liquid-metal head.

SUMMARY OF THE INVENTION

For this purpose, the subject of the invention is a method of lubricating a mold for the continuous casting of a metal product, of the type including a vigorously-cooled vertically-oscillating metal tubular element defining a passage for the cast metal and intended to cause, in contact with its wall in said passage, the solidification of said metal product, in which a lubricant in the liquid state is injected through said metal tubular element toward said metal product being solidified, wherein said injection is carried out at points distributed annularly at a single level of said tubular element, said level lying at a distance greater than 20 cm from the lowest level at which solidification of said product is able to be initiated, and in that the flow rate of said lubricant is sufficient to cause a fraction of said lubricant to rise up along said wall to the level at which solidification of said product is effectively initiated.

The subject of the invention is also a mold for a plant for the continuous casting of metal products, of the toe including a vigorously-cooled metal tubular element defining a passage for the cast metal and intended to cause, in contact with its wall in said passage, the solidification of said metal product, means for vertically oscillating said mold and means for injecting a lubricant in the liquid state through said metal tubular element toward said metal product being solidified, wherein said means are placed at a single level of said metal tubular element, said level lying at a distance greater than 20 cm from the lowest level at which solidification of said product is able to be initiated.

As will have been understood, the invention consists in localizing the injection of liquid lubricant at a level in the mold lying very substantially below the level at which solidification of the east product starts, and not at this level itself. The inventors have, in fact, observed that the vertical oscillatory movements of the mold could be sufficient to cause a significant rise of a fraction of the lubricant along the walls of the cooled metallic element. By suitably adjusting the point of lubricant injection and the parameters thereof, it is therefore possible to make a significant quantity of lubricant reach the level at which solidification starts and thus to ensure satisfactory lubrication of the mold over the entire height of its cooled metallic element, using only this injection. Moreover, this quantity must be quite modest in order not to cause unacceptable gas evolution in the mold. In conventional continuous casting, the cover powder is no longer used for this lubrication function and its composition may therefore be optimized in order for it best to fulfill its functions of trapping inclusions and protecting the surface of the liquid metal. In continuous casting with liquid-metal head, it is no longer necessary to inject liquid lubricant at several levels in the cooled element of the mold, thereby appreciably simplifying its design.

BRIEF DESCRIPTION OF THE DRAWINGS

The invention will be better understood on reading the description which follows, with reference to the appended figures.

DESCRIPTION OF PREFERRED EMBODIMENTS

Figure 1:
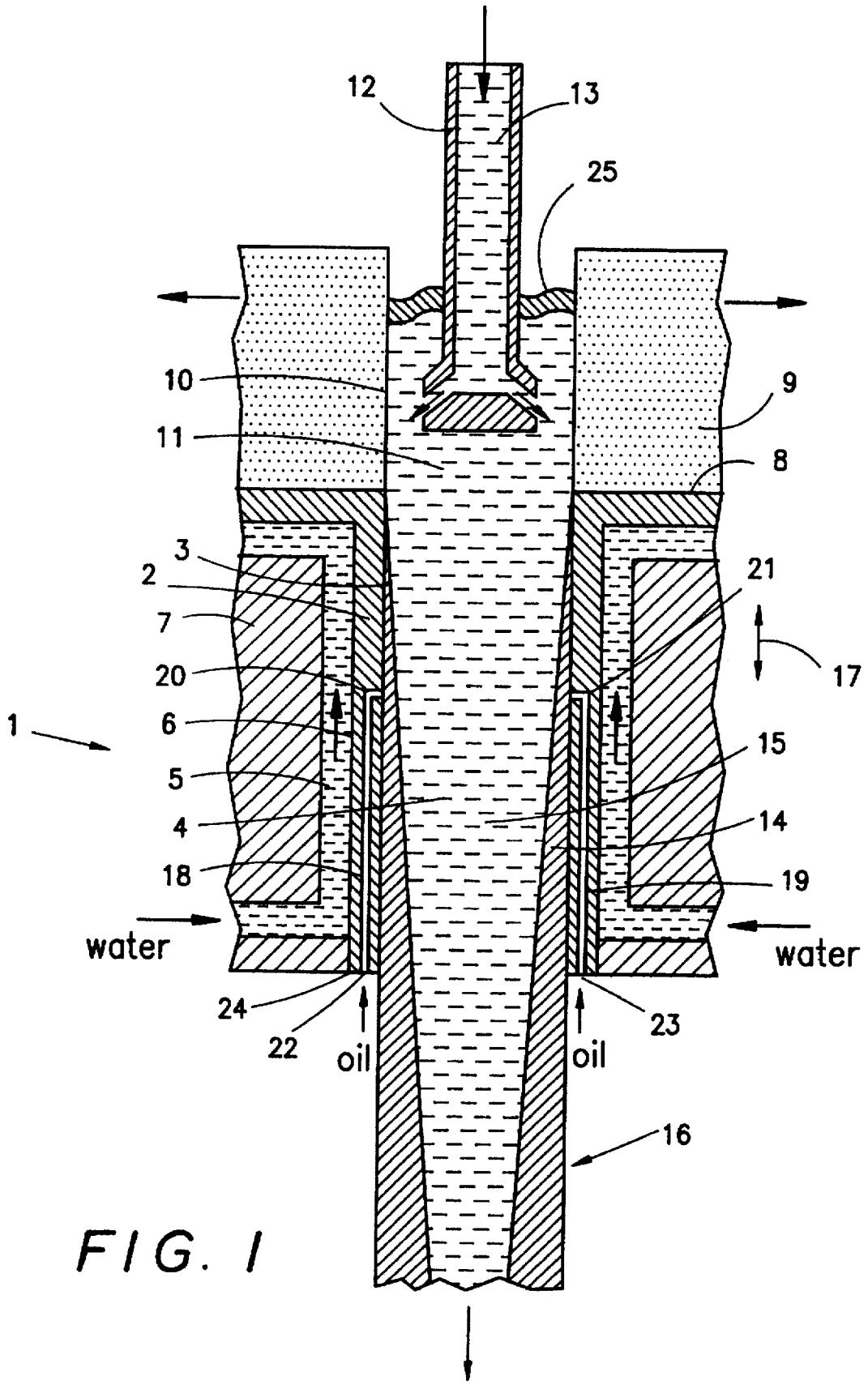
FIG. 1, which diagrammatically represents, seen in longitudinal section, a plant for the continuous casting with liquid-metal head of metals equipped with a mold according to the invention.

The mold 1 shown in FIG. 1 is, as is conventional in the continuous casting with liquid-metal head of steel or other metals, composed of two superimposed elements. The main element is a metallic tubular element 2 made of copper or copper alloy, the internal surface 3 of which defines a passage 4 having identical dimensions to those of the product which it is desired to cast and having a round, square or rectangular cross section. This metallic tubular element 2 may consist of a single piece (this is often the case for casting steel bars, billets or blooms) or may be formed by an assembly of plates, each of which corresponds to one face of the mold 1 (the general case for casting steel slabs). Conventionally, the metallic tubular element 2 is cooled by water circulation 5, provided, for example, between its external surface 6 and a jacket 7 which surrounds it. Around the upper edge 8 of the metallic tubular element 2 is fixed the second element of the mold, namely a bush 9 formed by a tubular element made of a refractory material such as a 90/10% alumina/silica mixture. The internal surface 10 of the bush 9 defines a passage 11 lying along the extension of the passage 4 defined by the internal surface 3 of the metallic tubular element 2. In the example shown, these two passages 4 and 11 have the same dimensions, but it is possible for one of them to have a smaller size than the other in order to make it more clear cut where solidification of the cast product starts. Also in a well-known manner, a submerged nozzle 12 connected to a tundish, not shown, containing the liquid metal 13 to be cast conveys the latter into the passage 11 internal to the bush 9. Since the latter is made of a thermally insulating material, solidification of the liquid metal 13 does not occur significantly on its walls and only starts when the liquid metal 13 comes into contact with the internal surface 3 of the cooled metallic element 2, i.e. level with the upper edge 8 of said element 2. This solidification results in the formation of a solidified steel skin 14, the thickness of which increases on moving down through the mold 1, surrounding the still-liquid core 15 of the cast product 16. This product 16 is continuously extracted from the mold 1 by a known device, not shown, installed in the lower stages of the machine. After it leaves the mold 1 in the partially solidified state, the product 16 continues to be cooled conventionally by means of a device, not shown, which sprays jets of water or a water/air mixture onto its external surface, the action of which starts immediately below the mold 1 and continues over a length of several meters. Next, the product 1 becomes fully solidified and fully cooled simply by convection and radiation. Conventionally, the mold 1 also includes a device, not shown, enabling it in its entirety to undergo vertical oscillatory movements in the direction of the arrow 17. These oscillations may be sinusoidal or may obey a more complex law. They usually have a frequency of a few Hz and an amplitude of a few mm.

The mold 1 also includes a device which lubricates the internal surface 3 of the cooled metallic tubular element 2 by injecting a lubricating liquid, such as oil, around the perimeter of this surface, the oil being intended to slip in between this surface 3 and the solidified skin 14 of the product 16. However, contrary to the usual practice in which this injection takes place at the top of the metallic element 2 and also in the lower part of this same element, according to the invention the lubricating liquid is injected only at a single level at a distance of more than 20 cm from the upper edge 8 of the cooled metallic element 2. This injection takes place via channels 18, 19 which are made in the walls of the metallic element 2 and conduct the lubricant to orifices 20, 21 emerging on the internal surface 3 of this element 2 so as to distribute the lubricant over the entire perimeter of the solidified skin 14 of the product 16. The lubricant itself is conveyed into the channels 18, 19 by means, not shown, connected to the lower orifices 22, 23 of the channels 18, 19 emerging on the lower edge 24 of the cooled metallic element 2.

As in other plants for continuous casting with liquid-metal head, it is desirable to cover the surface of the liquid metal 13 present in the mold 1 with a cover powder 25 which does not have to act as a lubricant for the internal surface 3 of the cooled metallic element 2. It is therefore easier to optimize its composition so that it performs best in protecting the metal 13 from reoxidation and in trapping the non-metallic inclusions.

Figure 2:
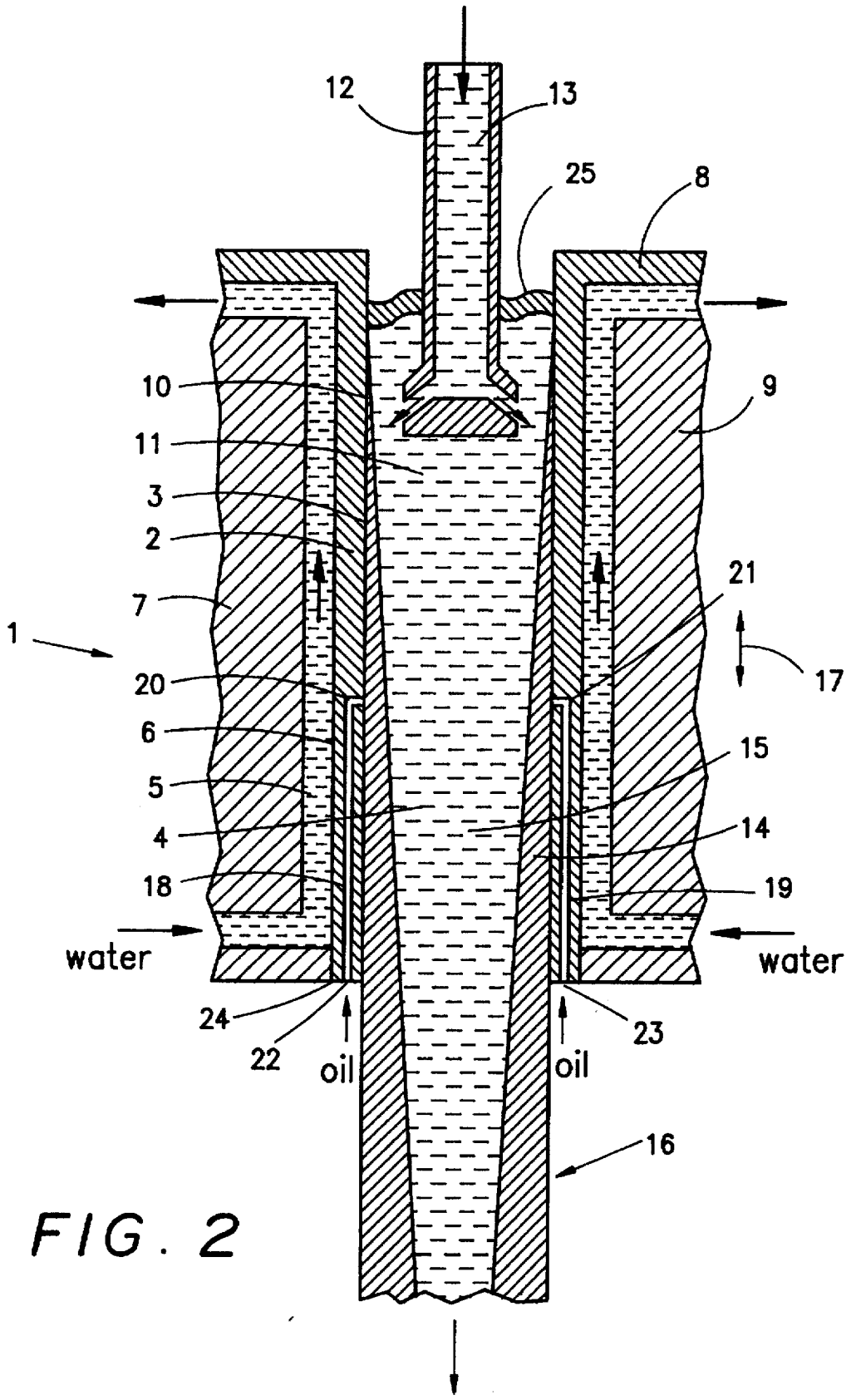
FIG. 2, which represents, in the same manner, a plant for conventional continuous casting equipped with a mold according to the invention.

The conventional continuous casting plant according to the invention, shown in FIG. 2, has its elements equivalent to the elements of the same kind and of the same function as the plant in FIG. 1 identified by the same references. This plant is distinguished from the previous one in that the cooled metallic tubular element 2 constitutes the entire internal face of the mold 1. There is therefore no longer a thermally insulating bush. The surface of the liquid metal 15 in the mold 1 is kept below the upper edge 8 of the metallic element 2, and this is at its level at which solidification of the skin 14 of the product 16 starts. As previously, according to the invention, the internal face of the mold 1 is entirely lubricated by injecting lubricating liquid some distance from the level where solidification of the skin 14 is initiated. In order not to observe excessive cracking of the lubricant in any case of use of the casting plant, it is necessary for this injection to be carried out at least 20 cm below the surface of the liquid metal 15. It is therefore necessary to place the lubricant injection device at least 20 cm below the lowest level at which solidification of the product 16 is able to start. It is also necessary to inject the lubricant at a rate such that, taking into account the other operating conditions, at any instant a significant fraction of the lubricant rises up along the walls of the cooled tubular element 2 to the level at which solidification of the product 16 effectively starts.

The essential advantage of such a technical solution, in conventional continuous casting, is to allow the use of a cover powder 25 whose composition is particularly suited to trapping the inclusions and to isolating the liquid metal 15 from the atmosphere, since it does not have to provide lubrication of the mold 1. Such suitability leads to the choice of a powder 25 which has a lower fluidity at its interface with the liquid metal 15 than would be necessary in traditional conventional continuous casting.

Figure 3:
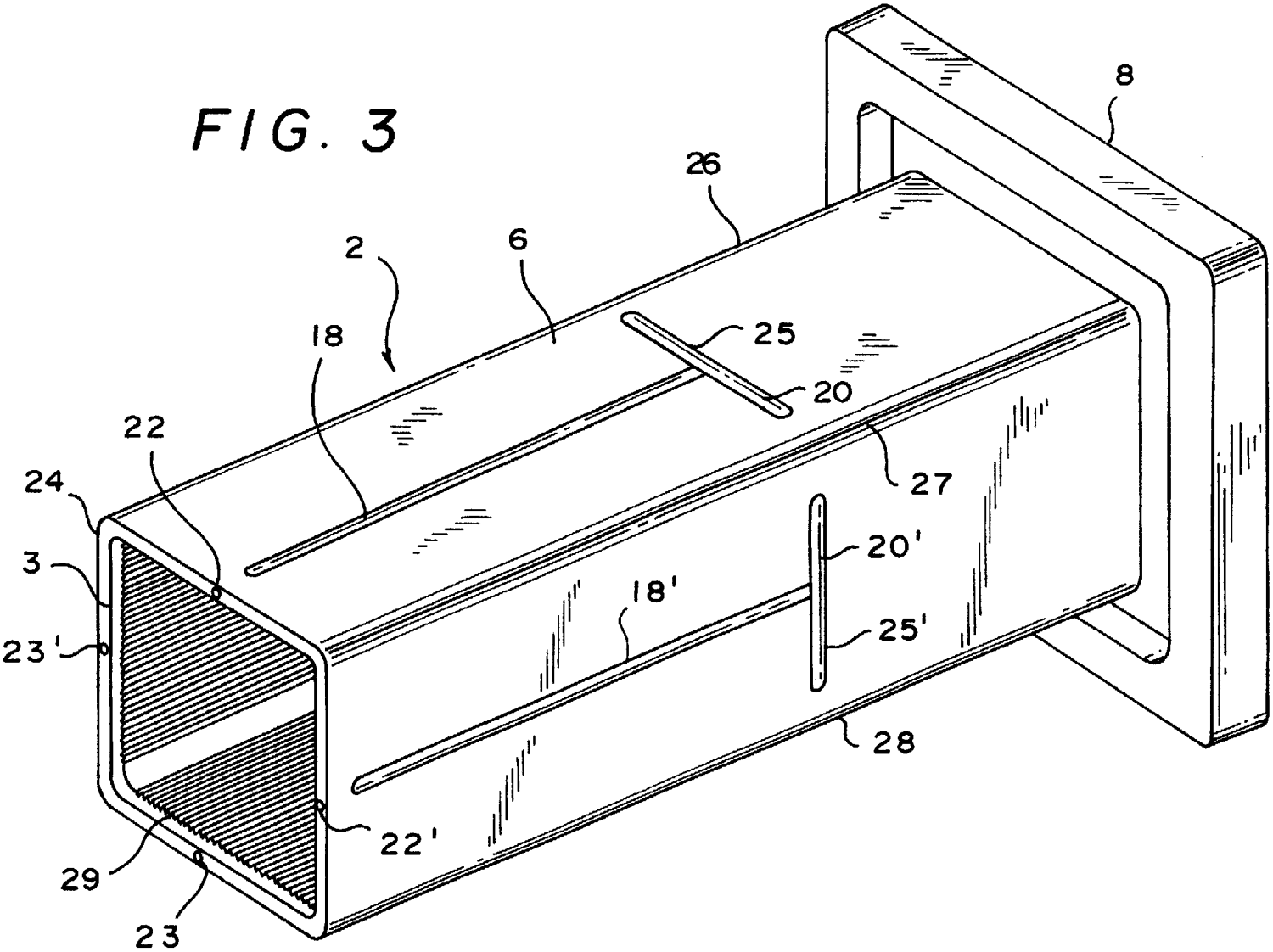
FIG. 3, which represents, in greater detail, an example of a metallic tubular element of a mold according to the invention.

FIG. 3 shows in greater detail a view of a non-limiting example of an embodiment of the metallic element 2 of the mold 1, stripped of the jacket 7 surrounding it when it is installed in the casting machine. This example is suitable for casting ferrometallurgical products having a 155 mm sided square cross section. In this example, it may be seen that the channels 18, 18' for conveying the lubricant consist of longitudinal grooves machined in the external surface 6 of the metallic element 2 which lie along the extension of holes, drilled in its lower edge 24, which constitute the lower orifices 22, 22', 23, 23' of the channels 18, 18', 19. These channels 18, 18', 19 each emerge, at their upper end, in a distribution chamber 25, 25' consisting of a recess machined transverse to the corresponding channel 18, 18', 19 in the external surface 6 of the metallic element 2, and which extends right up to near the edges 26, 27, 28 of said element 2. The bottom of each of these distribution chambers 25, 25' is drilled with a multiplicity of small holes 20, 20', 21 which emerge on the internal face 3 of the metallic element 2 and constitute the aforementioned orifices which convey the lubricant between the metallic element 2 and the solidified skin 14 of the cast product 16. The channels 18, 18', 19 and the distribution chambers 25, 25', after they have been machined, are closed in a sealed manner by covers (not shown) which are fixed to the external face 6 of the metallic element 2, for example by means of electron-beam welding. This method of fixing has the advantage of allowing the application of ultrasound to the mold 1 without causing deterioration of the sealing of the cover/metallic element 2 joints, something which would not be possible if screws were to be used for this fixing. It will be recalled that ultrasound can, in a known manner, contribute to improving the lubrication of the mold 1 and to increasing the efficiency of its cooling system.

Preferably, fine longitudinal grooves 29 are made on the internal face 3 of the metallic element 2, between its lower edge 24 and the chambers 25, 25' for distributing the lubricant in line with the orifices 20, 20', 21. These grooves facilitate the evacuation of excess lubricating liquid and of gases resulting from its cracking to the lower part of the mold 2.

By way of example, the main dimensional characteristics of the various elements which have just been mentioned may be:

- length of the metallic element 2: 700 mm;
- internal section of the metallic element 2: 155 mm sided square;
- thickness of the wall of the metallic element 2:11 mm;
- width of the channels 18, 18', 19 and diameter of their lower orifices 22, 22', 23, 23': 3 mm;
- distances between the distribution chambers 25, 25' and the edges of the metallic element 2: 10 mm;
- diameter of the orifices 20, 20', 21 conveying lubricant onto the internal face of the metallic element 2: 0.5 mm;
- number of these orifices 20, 20', 21: 28 for each distribution chamber 25, 25';

distance between these orifices 20, 20', 21 and the upper edge 8 of the metallic element 2: 350 mm; and dimensions of the longitudinal grooves 29 for evacuating the lubricant toward the bottom of the metallic element 2: width 0.5 mm and depth 1 mm.

As was stated, the invention is based on the observation that, under the effect of the oscillations of the mold 1, part of the lubricating liquid has the possibility of rising up along the walls of the metallic tubular element 2 to a height which may be relatively great. It is therefore possible to lubricate the entire height of the cooled tubular element 2 of the mold 1 by injecting lubricant at a single level, if its flow rate, given the other operating conditions, is sufficient. For this purpose, it is necessary to locate the level of the injection of lubricating liquid at a suitable point, that is to say:

sufficiently far from the upper end 8 of the cooled element 2 at which solidification of the skin 14 is initiated so as to eliminate the risk of significant cracking of the lubricant, which the invention specifically aims to avoid;

but also sufficiently close to this same end that a suitable quantity of lubricant can reach there, given the other operating conditions.

The parameters to be taken into account for determining the optimum point of injection of the lubricant in a mold of a given format are essentially the rate of casting of the product 16, the amplitude and frequency of the oscillations of the mold 1 and the flow rate of injected lubricant. All other things being equal, the lubricant rises up along the metallic element 2 to a height which is all the greater the higher the flow rate and the lower the rate of casting. The mold 1 must therefore be designed so that, just by varying the flow rate of lubricant, it is possible to achieve correct lubrication of the entire mold 1 for all the operating conditions under which it is likely to be used.

It would be conceivable to inject the lubricant at a distance relatively close to the point where solidification of the product 16 is initiated (less than 20 cm) and to inject only a small quantity in order to avoid the cracking phenomena from becoming excessive. However, this quantity of lubricant would no longer be sufficient to ensure satisfactory lubrication of the entire bottom part of the mold 1 in every case of use. It would then also be necessary to inject lubricant at a second level lying in this bottom part, which would remove a large part of its advantage with respect to the recommended approach.

In practice, for the previously described mold of 155 mm sided square cross section, used in continuous casting with liquid-metal head, it has been observed that, for a rate of casting of the product of 1.5 m/min and with oscillations of 3 Hz in frequency and 2.5 mm in amplitude, if the orifices 20, 20', 21 for injecting the lubricant are placed 350 mm from the upper edge 8 of the metallic element 2, it is necessary to inject approximately 12.5 $cm^3$ of oil per minute on each face of the mold so that the oil can rise up to the desired level. An oil flow rate limited to 10 $cm^3$ per minute and per face would, under these same conditions, only cause the oil to rise up to a distance of 250 mm, which would be insufficient to lubricate the upper part of the metallic element 2. However, if the rate of casting is lowered to 1 m/min, an oil flow rate of 7 $cm^3$ per minute per face is sufficient to lubricate the entire metallic element 2.

Of course, without departing from the spirit of the invention, it is possible to imagine alternative forms of execution of the molds which have just been described. In particular, it should be understood that the means for conveying the lubricant may have a shape other than that exemplified. Moreover, it is clear that the invention may be applied to the continuous casting of any metal, and not just to that of steel.

We claim:

1. A method of lubricating a mold for the continuous casting of a metal product, wherein the mold includes a vigorously-cooled vertically-oscillating metal tubular element defining a passage for the cast metal and intended to cause, in contact with its wall in said passage, the solidification of a metal product, and wherein a flow of lubricant in a liquid state is injected through said metal tubular element toward said metal product being solidified, comprising the steps of carrying out said injection at points distributed annularly at a single level of said tubular element, said level lying at a distance greater than 20 cm from the lowest level at which solidification of said product is able to be initiated, and wherein the flow rate of said lubricant is sufficient to cause a fraction of said lubricant to rise up along said wall to the level at which solidification of said product is effectively initiated.

2. The method as defined in claim 1, wherein said mold includes a tubular bush made of a thermally insulating material that is placed on an upper edge of said cooled metal tubular element and lies along its extension, and further comprising the step of maintaining the surface of the metal cast in the mold inside said bush.

3. The method as claimed in claim 1, wherein said lubricant is oil.

4. A mold for a plant for the continuous casting of metal products, comprising a vigorously-cooled metal tubular element having a wall defining a passage for a cast metal and intended to cause, as a result of contact with its wall defining said passage, the solidification of said metal, means for vertically oscillating said mold and means for injecting a lubricant in the liquid state through said metal tubular element toward said metal being solidified, wherein said means are placed at a single level of said metal tubular element, said level lying at a distance greater than 20 cm from the lowest level at which solidification of said metal is able to be initiated.

5. The mold as claimed in claim 4, which includes a tubular bush made of a thermally insulating material placed on the upper edge of said cooled metal tubular element and lying along its extension, and wherein said means for injecting a lubricant in the liquid state lie at least 20 cm below said upper edge.

6. The mold as claimed in claim 4, wherein said means for injecting a lubricant in the liquid state comprises channels which are provided in the wall of the metal tubular element each of which emerges in a distribution chamber drilled with a multiplicity of holes emerging on an internal face of the metal tubular element, and means for conveying said lubricant into said channels.

* * * * *